US007795898B2

(12) United States Patent
Masuya et al.

(10) Patent No.: US 7,795,898 B2
(45) Date of Patent: Sep. 14, 2010

(54) FAN HAVING FUNCTION FOR DETECTING FAULT IN THE FAN

(75) Inventors: Michi Masuya, Yamanashi (JP); Mitsuyuki Taniguchi, Gotenba (JP); Yoshinobu Maeda, Yamanashi (JP); Shinichi Kinoshita, Yamanashi (JP)

(73) Assignee: FANUC Ltd, Minamitsuru-gun, Yamanashi (JP)

( * ) Notice: Subject to any disclaimer, the term of this patent is extended or adjusted under 35 U.S.C. 154(b) by 1036 days.

(21) Appl. No.: 11/339,531

(22) Filed: Jan. 26, 2006

(65) Prior Publication Data

US 2006/0199521 A1 Sep. 7, 2006

(30) Foreign Application Priority Data

Jan. 27, 2005 (JP) ..... 2005-020125

(51) Int. Cl.
*G01R 31/34* (2006.01)
*G01R 31/06* (2006.01)

(52) U.S. Cl. ..... 324/772; 324/545; 417/423.1; 318/638

(58) Field of Classification Search ..... 417/44.11, 417/410.1, 423.1, 63; 310/162, 68 B, 68 C, 310/68 R; 324/545–547, 772; 318/638, 318/647, 648, 650, 400.21, 400.22, 471; 388/806, 808, 815, 823, 934
See application file for complete search history.

(56) References Cited

U.S. PATENT DOCUMENTS 3,575,527 A 4/1971 Watanabe et al.
5,952,758 A * 9/1999 Lucidarme et al. ..... 310/162
6,023,138 A 2/2000 Fried et al.
6,163,266 A 12/2000 Fasullo et al.
2002/0187049 A1 12/2002 Lee
2004/0245866 A1 * 12/2004 Lopatinsky et al. ..... 310/64
2004/0263341 A1 12/2004 Enzinna

FOREIGN PATENT DOCUMENTS

DE 44 08 805 A1 9/1995

(Continued)

OTHER PUBLICATIONS

European Search Report mailed Jul. 25, 2008 issued in EP Application No. 06001454.5.

(Continued)

*Primary Examiner*—Devon C Kramer
*Assistant Examiner*—Patrick Hamo
(74) *Attorney, Agent, or Firm*—Drinker Biddle & Reath LLP

(57) ABSTRACT

A fan having a function for detecting a fault such as a breakage or a loss of a rotating part of the fan as well as reduction in the rotational speed of the fan, the function being not affected by an operating condition of the fan. The fan includes a stationary part, a rotating part rotatably attached to the stationary part, a first electric circuit arranged on the rotating part, a second electric circuit arranged on the stationary part, the second electric circuit being electromagnetically connected to the first circuit, and a fault detecting circuit electrically connected to the second electric circuit, for detecting a fault of the rotating part.

9 Claims, 10 Drawing Sheets

FOREIGN PATENT DOCUMENTS

| | | |
|---|---|---|
| JP | 60-165532 | 8/1985 |
| JP | 63-065302 | 3/1988 |
| JP | 2-115595 | 4/1990 |
| JP | 9-311009 | 12/1997 |
| JP | 2003-307194 | 10/2003 |

OTHER PUBLICATIONS

Japanese Notice of Reasons for Rejection mailed Aug. 25, 2009 issued in Japanese Patent Application No. 2005-020123 (including partial translation thereof.

* cited by examiner

FAN HAVING FUNCTION FOR DETECTING FAULT IN THE FAN

BACKGROUND OF THE INVENTION

1. Field of the Invention

The present invention relates to a fan having a function for detecting a fault in the fan.

2. Description of the Related Art

In the prior art, in order to detect various faults, in fans, such as the breakage and the loss of a rotating part such as a vane of the fan and/or stoppage and deceleration of the rotation of the fan, various methods, utilizing light, magnetism, ultrasound or air pressure, or monitoring the current through the motor of the fan, have been developed. For example, Japanese Unexamined Patent Publication No. 2003-307194 discloses a device, for detecting an abnormal rotational speed of a fan, having a function for outputting a pulse signal synchronized with a period of a current. This device judges the deceleration of the rotational speed when a period of the pulse signal becomes longer.

Any of the above methods utilizing light, magnetism, ultrasound or air pressure cannot be used, depending on a type and/or an operating condition of a fan to be detected. Further, in a method using a pulse signal as described in Japanese Unexamined Patent Publication No. 2003-307194, a breakage and a loss of a vane of a fan cannot be detected. Therefore, such a fault must be found by a visual inspection.

SUMMARY OF THE INVENTION

Therefore, an object of the present invention is to provide a fan having a function for detecting a fault, such as a breakage or a loss of a rotating part of the fan, as well as deceleration of a rotational speed of the part, the function not being affected by an operating condition of the fan.

In order to achieve the object, the present invention provides a fan comprising: a stationary part; a rotating part rotatably attached to the stationary part; a first electric circuit arranged on the rotating part; a second electric circuit arranged on the stationary part, the second electric circuit being electrically, magnetically or electromagnetically connected to the first circuit; and a fault detecting circuit electrically connected to the second electric circuit, for detecting a fault of the rotating part based on a value of a current flowing through the second electric circuit.

The first and second electric circuits may be configured such that the electric, magnetic or electromagnetic connection between the first and second electric circuits may be strengthened or weakened, depending on the position of the rotating part relative to the stationary part.

The first electric circuit may have an electric wire for detecting a breakage of a portion of the rotating part.

In one embodiment, the first and second electric circuits respectively have first and second coils adjacent to each other. It is preferable that each of the first and second coils is formed in the shape of oval, the ovals being generally congruent and the centers of the ovals being positioned on a rotational axis of the rotating part. In the embodiment, the rotating part is preferably made of a nonmagnetic material.

In another embodiment, the first and second electric circuits respectively have first and second electrodes adjacent to each other. It is preferable that each of the first and second electrodes has two arcs opposed each other in relation to a rotational axis of the rotating part, the arcs of the first electrode and the arcs of the second electrode having the same radius. In the embodiment, the rotating part is preferably made of a nonconductive material.

BRIEF DESCRIPTION OF THE DRAWINGS

The above and other objects, features and advantages of the present invention will be made more apparent by the following description of the preferred embodiments thereof, with reference to the accompanying drawings, wherein.

DETAILED DESCRIPTION

Figure 1:
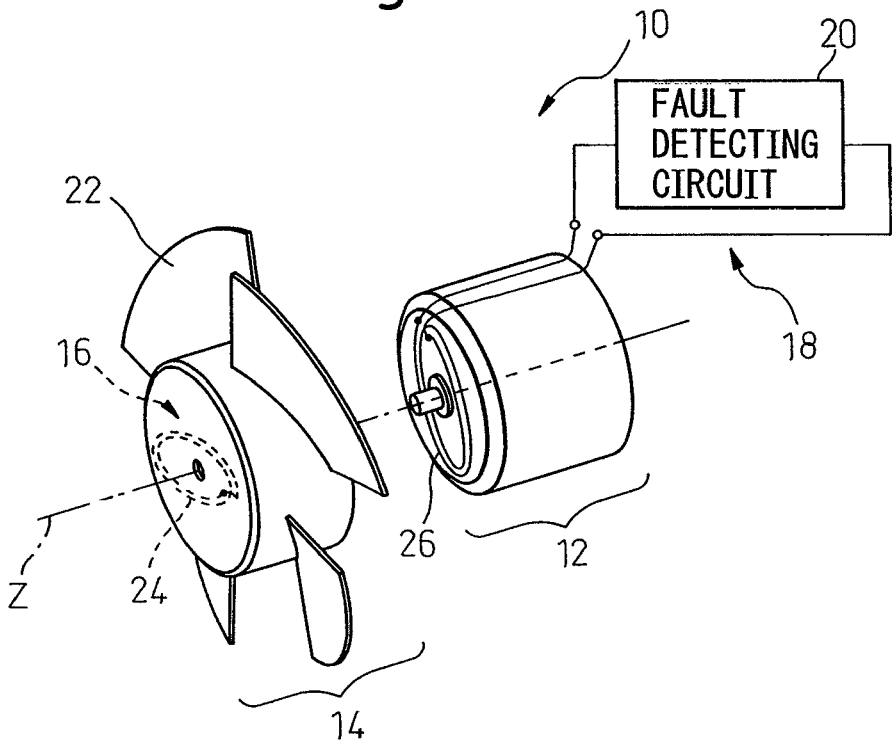
FIG. 1 is a perspective view of a fan according to a first embodiment of the invention.

The detail of the invention will be described below with reference to the drawings. A fan 10 according to a first embodiment of the invention as shown in FIG. 1 includes a stationary part 12; a rotating part 14 rotatably attached to the stationary part 12; a first electric circuit 16 arranged on the rotating part 14; a second electric circuit 18 arranged on the stationary part 12, the second electric circuit 18 being electromagnetically connected to the first circuit 16; and a fault detecting circuit 20 electrically connected to the second electric circuit 18, for detecting a fault of the rotating part 14. As the fan 10 is a kind of propeller fan, a plurality of vanes 22 are attached to the rotating part 14.

Figure 2:
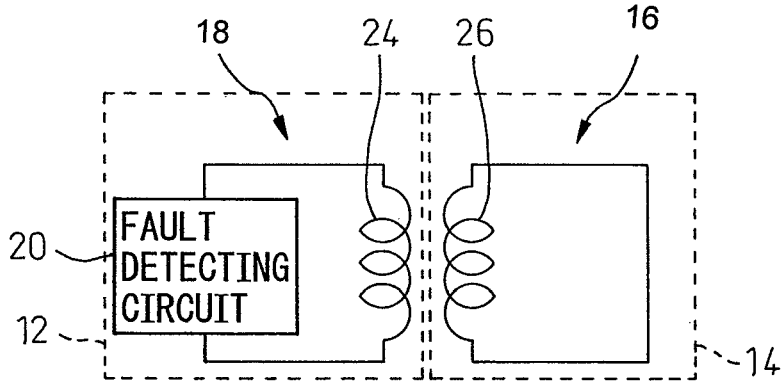
FIG. 2 is a diagram showing an equivalent circuit of an electric circuit of the fan of FIG. 1.

As shown, the first electric circuit 16 has a first coil 24 formed or wound in the shape of oval, the center of which is positioned on a rotational axis Z of the rotating 14. Similarly, the second electric circuit 18 has a second coil 26 formed or wound in the shape of oval, the center of which is also positioned on the rotational axis Z. The first and second coils 24 and 26 are adjacent to each other and are preferably generally congruent, so as to alternately indicate weak and strong connections between the two coils. An equivalent circuit of the circuits of the fan 10 is shown in FIG. 2. Due to this configuration, the fault detecting circuit 20 may easily and surely detect stoppage or deceleration of the rotation of the rotating part 14 and a displacement or a loss of the rotating part 14, as described below.

Figure 3A:
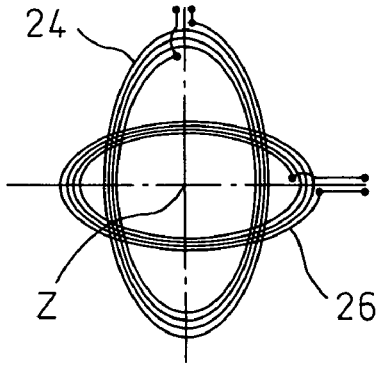
FIGS. 3*a* and 3*b* show relative positions of two coils in the shape of oval, indicating weak and strong connections between the two coils, respectively.
Figure 3B:
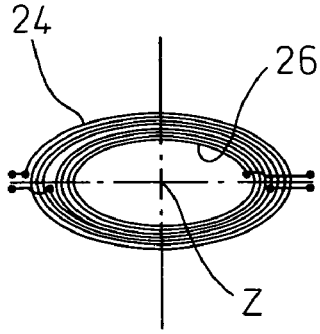
Figure 4A:
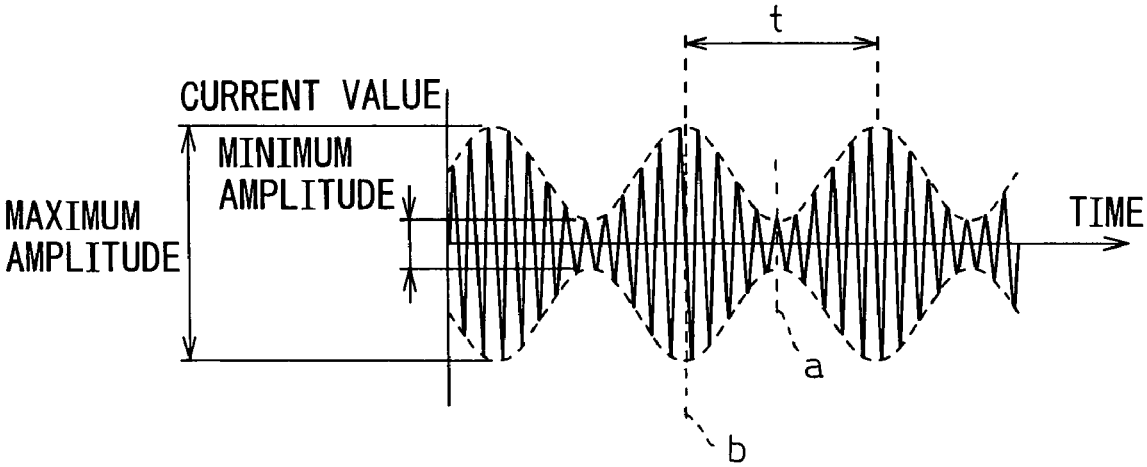
FIGS. 4*a* and 4*b* are graphs indicating current values flowing through the electric circuit when the fan is rotated in a normal speed and in a decelerated speed, respectively.
Figure 4B:
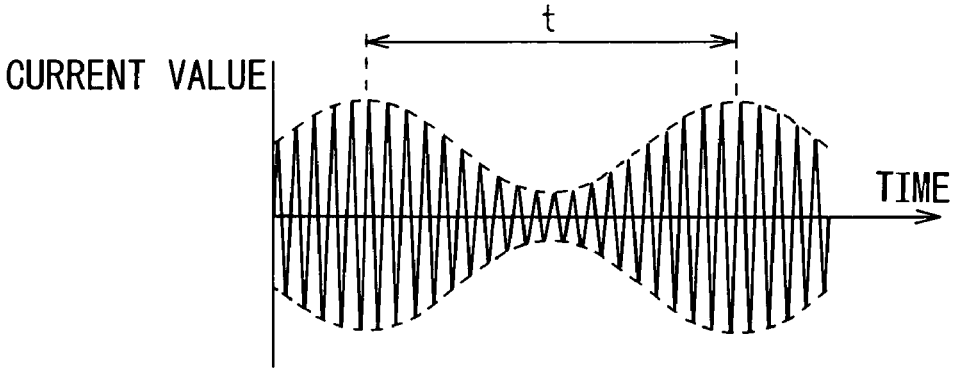

FIGS. 3*a* and 3*b* show different relative positions of the first and second coils 24 and 26 on a plane perpendicular to the axis Z. As described above, both of the coils 24 and 26 are formed in the shape of oval. Therefore, during the rotation of the rotating part 14, a weak electric connection (FIG. 3*a*) and a strong electric connection (FIG. 3*b*) between the coils are repeated at a constant period. Accordingly, a waveform of an actual current flowing through the second electric circuit 18 is presented as shown in FIG. 4*a*. FIG. 4*a* shows a state in which the fan normally rotates at a predetermined rotational speed. Points "a" and "b" in FIG. 4*a* correspond to states illustrated by FIGS. 3*a* and 3*b*, respectively. If the rotational speed of the fan is reduced by an error, for example as shown in FIG. 4*b*, a period t of an amplitude change of the waveform becomes longer. Therefore, by detecting the change of the period t, an abnormality of the rotational speed of the fan may be found.

Figure 5:
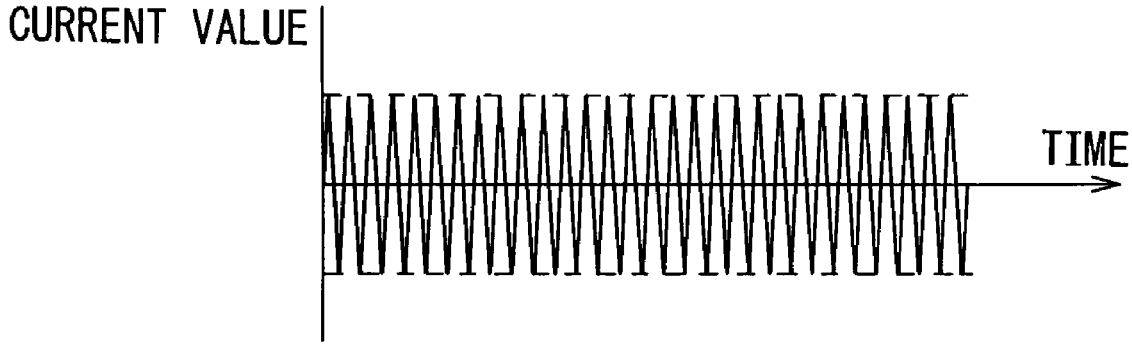
FIG. 5 is a graph indicating a current value flowing through the electric circuit when the fan is stopped.

In case that the rotation of the fan is stopped, the relative position of the first and second coils 24 and 26 does not alter. Therefore, the current flowing through the second circuit 18 has a constant amplitude, as shown in FIG. 5. In other words, when the waveform as shown in FIG. 5 is observed, the fan may be considered to be stopped by an error.

Figure 6:
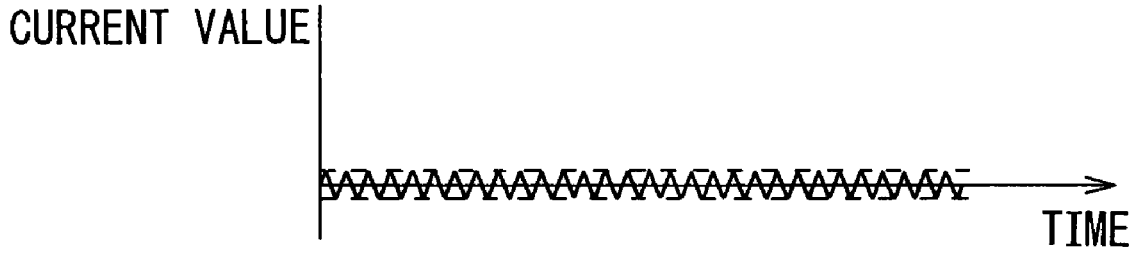
FIG. 6 is a graph indicating a current value flowing through the electric circuit when a portion of the fan is broken.

Further, when the rotating part 14 is offset relative to the stationary part 12, the relative position as shown in FIG. 3*b*, in which the connection between the first and second coils 24 and 26 is strong, cannot be achieved. Therefore, in comparison with FIG. 4*a*, a maximum amplitude of the current flowing through the second circuit becomes smaller. In addition, when the rotating part 14 is lost from the stationary part 12, the waveform of the current has not only a constant but also small amplitude, as shown in FIG. 6.

Figure 7:
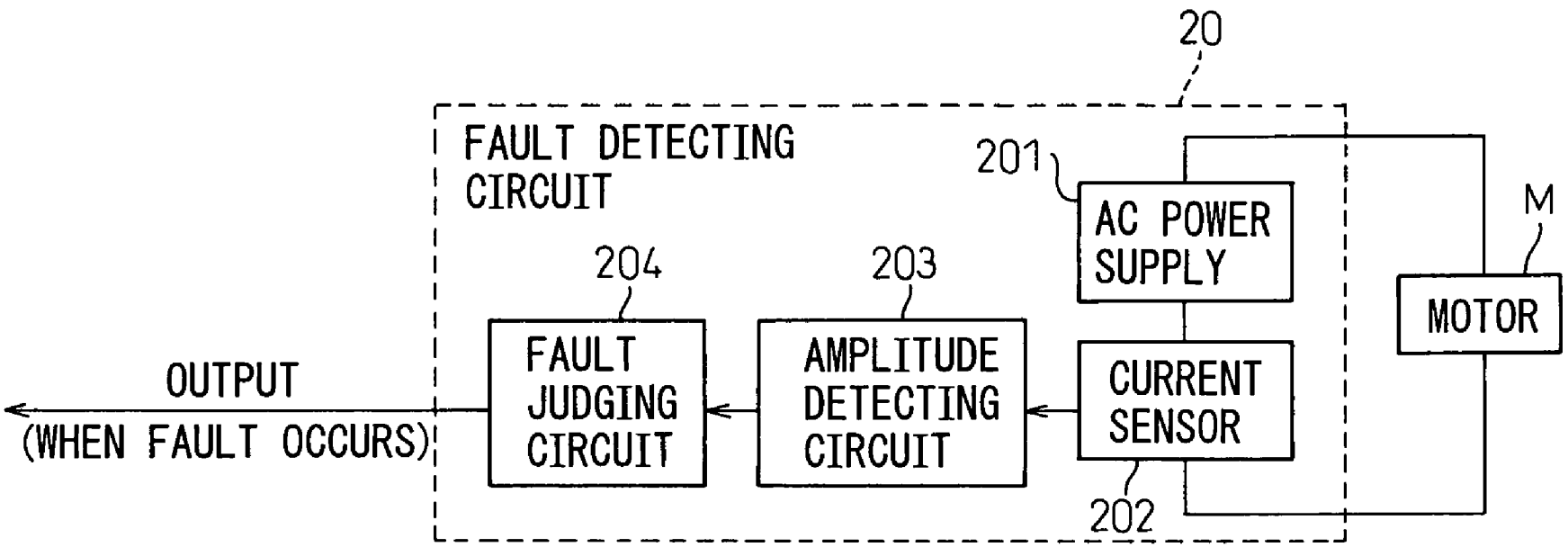
FIG. 7 is a block diagram showing a preferable configuration of a fault detecting circuit for the fan.
Figure 8:
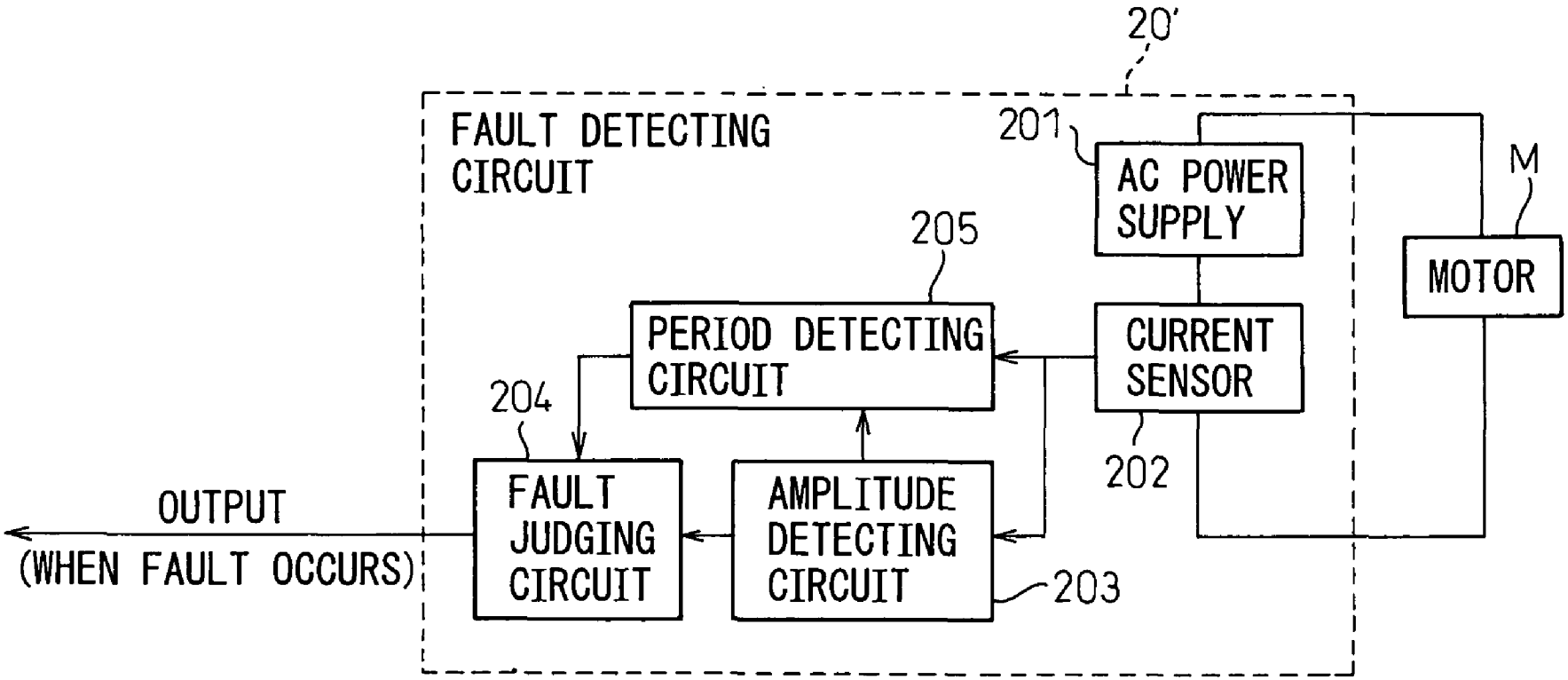
FIG. 8 is a block diagram showing another preferable configuration of a fault detecting circuit for the fan.

FIGS. 7 and 8 are block diagrams showing preferable configurations of fault detecting circuit 20 and 20', respectively, for detecting the stoppage or deceleration of the fan and/or the loss or offset of the rotating part of the fan. The fault detecting circuit 20 as shown in FIG. 7 has an AC power supply 201 for supplying power to a motor M of the ran 10, a current sensor 202 for detecting the current flowing through the second coil 26, an amplitude detecting circuit 203 for detecting the amplitude of the current based on a signal from the current sensor 202, a fault judging circuit 204 for judging whether the amplitude detected by the circuit 203 is abnormal or not and outputting a signal when the amplitude is abnormal. Due to this configuration, the reduction of the amplitude indicating the loss of the rotating part of the fan may be detected.

The fault detecting circuit 20' as shown in FIG. 8 has, in addition to the components of fault detecting circuit 20 of FIG. 7, a period detecting circuit 205 for detecting the period of the amplitude change of the current based on the amplitude detected by the amplitude detecting circuit 203. In this configuration, the fault judging circuit 204 may judge an abnormal period of the amplitude change or an abnormal rotational speed of the fan, as well as an abnormality in the amplitude itself.

Figure 9:
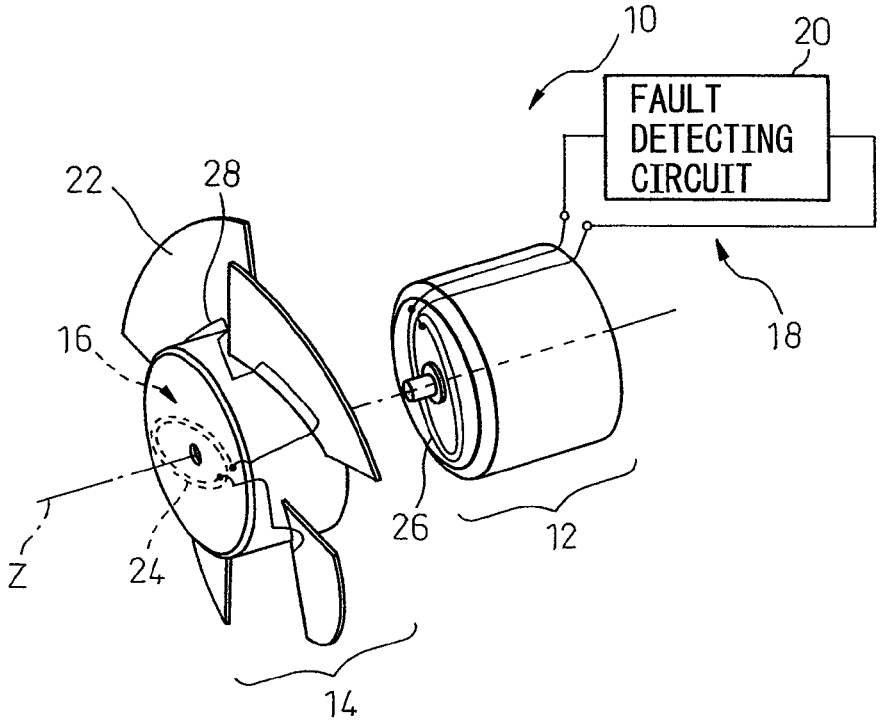
FIG. 9 is a perspective view of the fan according to the first embodiment of the invention further including an electric wire for detecting a breakage of the fan.
Figure 10:
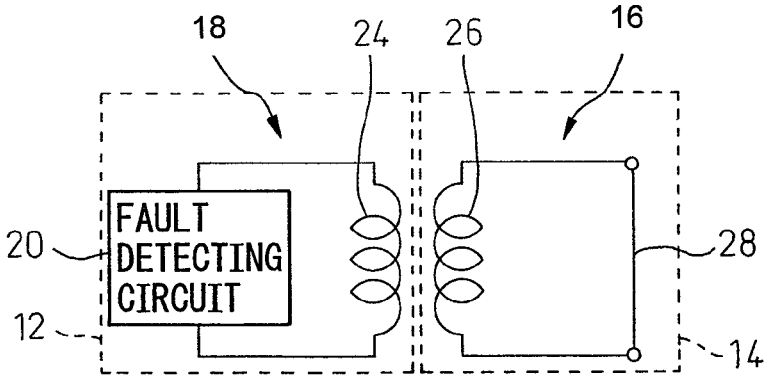
FIG. 10 is a diagram showing an equivalent circuit of an electric circuit of the fan of FIG. 9.

The fan 10 may further include a function for detecting a loss of a portion of the rotating part 14, such as the vane 22. For example, as shown in FIG. 9, the first electric circuit 16 may further has an electric wire 28, connected to the first coil 24 and arranged along the vane 22, for detecting a breakage of the vane. FIG. 10 shows an equivalent circuit of the configuration of FIG. 9. Due to this configuration, when the vane 22 is damaged or lost, the wire 28 is also broken and current does not flow through the first circuit 16, which may be detected by the above fault detecting circuit 20 or 20' of the second electric circuit 18.

Figure 11A:
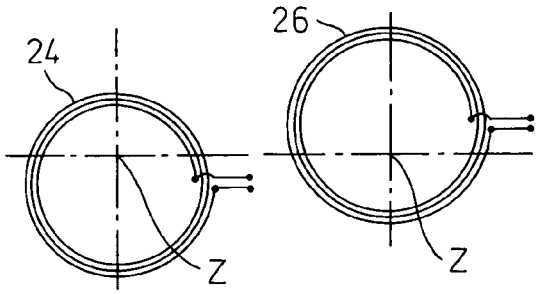
FIG. 11*a* is a view indicating two circular coils offset from each other.
Figure 11B:
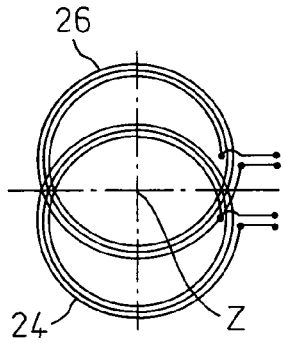
FIGS. 11*b* and 11*c* show relative positions of the two coils of FIG. 11*a*, indicating weak and strong connections between the two coils, respectively.
Figure 11C:
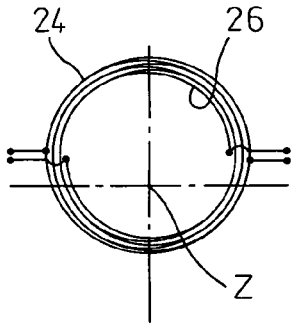

In the above embodiment, each of the first and second coils 24 and 26 has an oval shape. However, the shape of each coil is not limited to the oval. For example, as shown in FIG. 11*a*, each of the first and second coils may have the shape of circle, the center of which is offset from each other. Also in this case, during the rotation of the fan, the weak electromagnetic connection as shown in FIG. 11*b* and the strong electromagnetic connection as shown in FIG. 11*c* are alternately repeated at a predetermined period, whereby the same effect as in case of the oval shape of the coil may be obtained.

Figure 12:
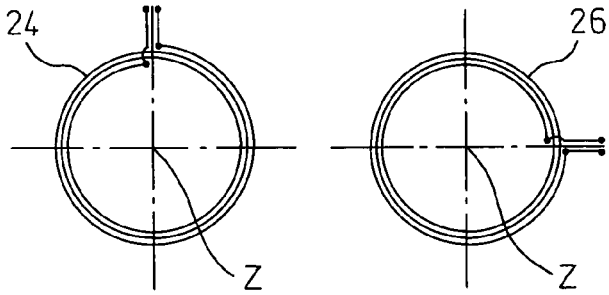
FIG. 12 shows another configuration of coils for detecting a breakage or a loss of the rotating part.

When the fault detecting circuit 20 or 20' is required to detect only the loss of the rotating part, each of the first and second coils 24 and 26 may have the shape of circle, the center of which coincides with each other, as shown in FIG. 12. In this case, the amplitude of the current does not periodically change as shown in FIG. 4*a* or 4*b* even when the rotational speed of the fan is changed. However, the loss of the rotating part 14 may be detected, as the current is remarkably reduced.

Figure 13:
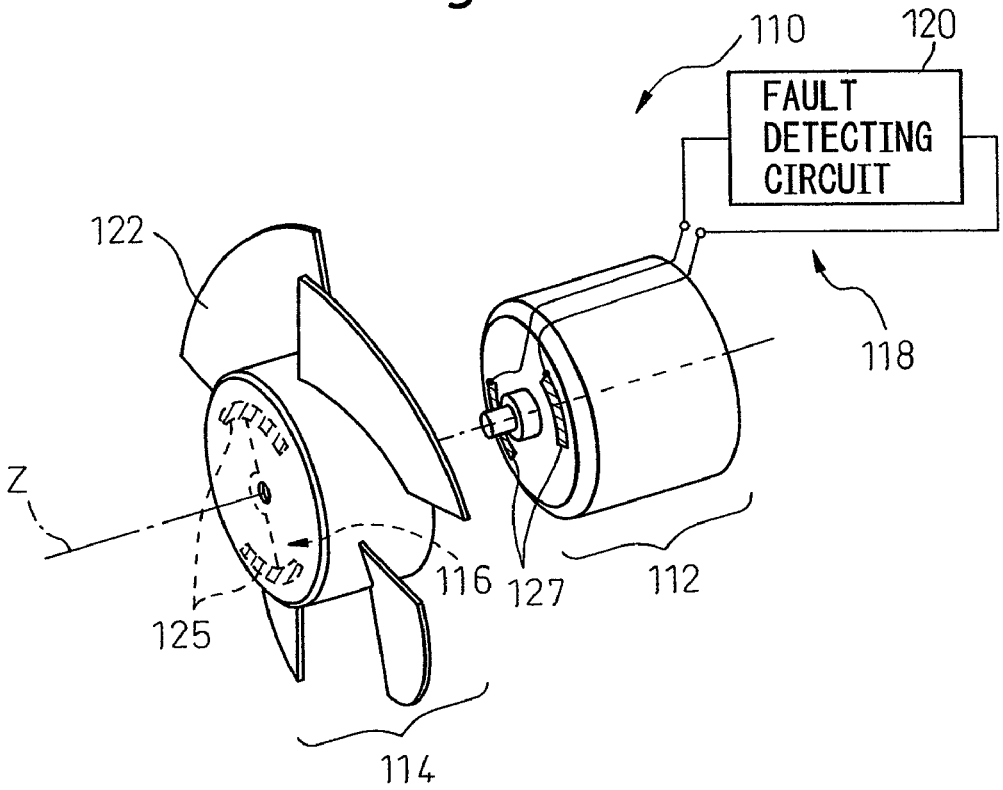
FIG. 13 is a perspective view of a fan according to a second embodiment of the invention.
Figure 14:
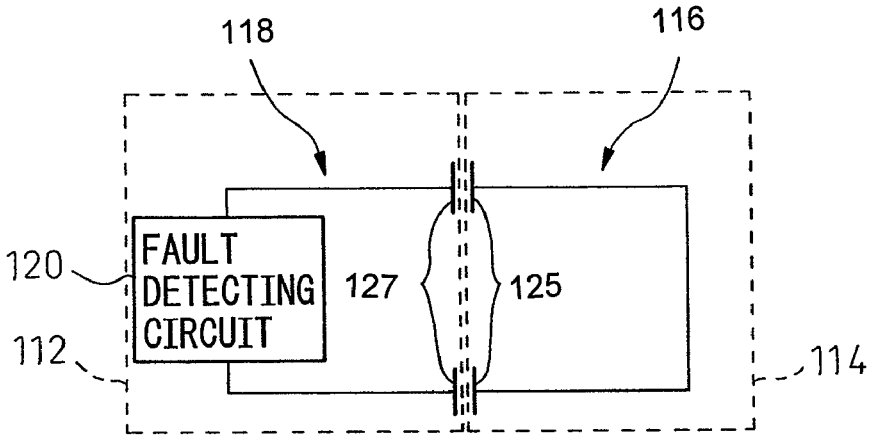
FIG. 14 is a diagram showing an equivalent circuit of an electric circuit of the fan of FIG. 13.

Next, a fan according to a second embodiment of the invention is described with reference to FIGS. 13 and 14. A fan 110 of the second embodiment, as shown in FIG. 13, is different from the fan 10 of the first embodiment in that the fan 110 includes first and second electrodes 125 and 127 instead of the first and second coils 24 and 26 of the first and second electric circuit of the fan 10. As other components of the fan 110 may be the same as those of the fan 10, the components of the fan 110 are indicated by reference numerals made by adding 100 to the reference numerals of the components of the fan 10. FIG. 14 shows an equivalent circuit of the configuration of FIG. 13. Due to this configuration, a fault detecting circuit 120 may easily and surely detect stoppage or deceleration of the rotation of a rotating part 114 and a displacement or a loss of the rotating part 114.

The first electrode 125 includes two arcs positioned on the rotating part 114 and opposed each other in relation to a rotational axis Z of the fan 110. In more detail, the two arcs are positioned rotational symmetrically about the axis Z by 180 degrees. Also, the second electrode 127 includes two arcs positioned on a stationary part 112 and opposed each other in relation to the rotational axis Z of the fan 110. The first and second electrodes 125 and 127 are adjacent to each other and preferably include the arcs having generally the same radius so as to alternately indicate strong and weak electrical connections between the two electrodes.

Figure 15A:
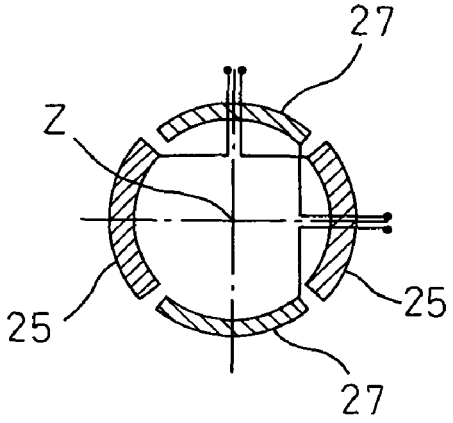
FIGS. 15*a* and 15*b* show relative positions of two electrodes each having two arcs, indicating weak and strong connections between the two electrodes, respectively.
Figure 15B:
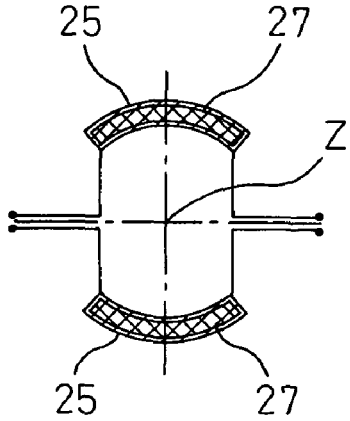

In the fan 110 of the second embodiment, stoppage or deceleration of the rotation of the rotating part 114 and a displacement or a loss of the rotating part 114 may also be detected by the same concept of the first embodiment. Concretely, as shown in FIGS. 15*a* and 15*b*, indicating the different relative rotational positions of the first and second electrodes 125 and 127, during the rotation of the rotating part 114, the weak electric connection as shown in FIG. 15*a* and the strong electric connection as shown in FIG. 15*b* are alternately repeated at a predetermined period. Therefore, the waveform of the current flowing through a second electric circuit 118 is the similar to the waveform as shown in FIG. 4*a*. If the rotational speed of the fan is reduced by an error, for example as shown in FIG. 4*b*, a period of an amplitude change of the waveform becomes longer. Therefore, by detecting the change of the period, an abnormality of the rotational speed of the fan may be found.

When the rotating part 114 of the fan 110 is not rotated, the relative position of the first and second coils 24 and 26 does not alter. Therefore, the current flowing through the second circuit 118 has a constant amplitude, as shown in FIG. 5. In other words, when such a waveform is observed, the fan may be considered to be stopped by an error.

Further, when the rotating part 114 is offset relative to the stationary part 112, the relative position as shown in FIG. 15*b*, in which the connection between the first and second electrodes 125 and 127 is strong, cannot be achieved. Therefore, in comparison with FIG. 4*a*, a maximum amplitude of the current flowing through the second circuit 118 becomes smaller. In addition, when the rotating part 114 is lost from the stationary part 112, the current hardly flows through the second circuit.

The preferable configuration of the fault detecting circuit 120, for detecting stoppage or deceleration of the rotation of the rotating part 114 and a displacement or a loss of the rotating part 114, may be the same as that of the fault detecting circuit 20 or 20' as shown in FIG. 7 or 8.

Figure 16:
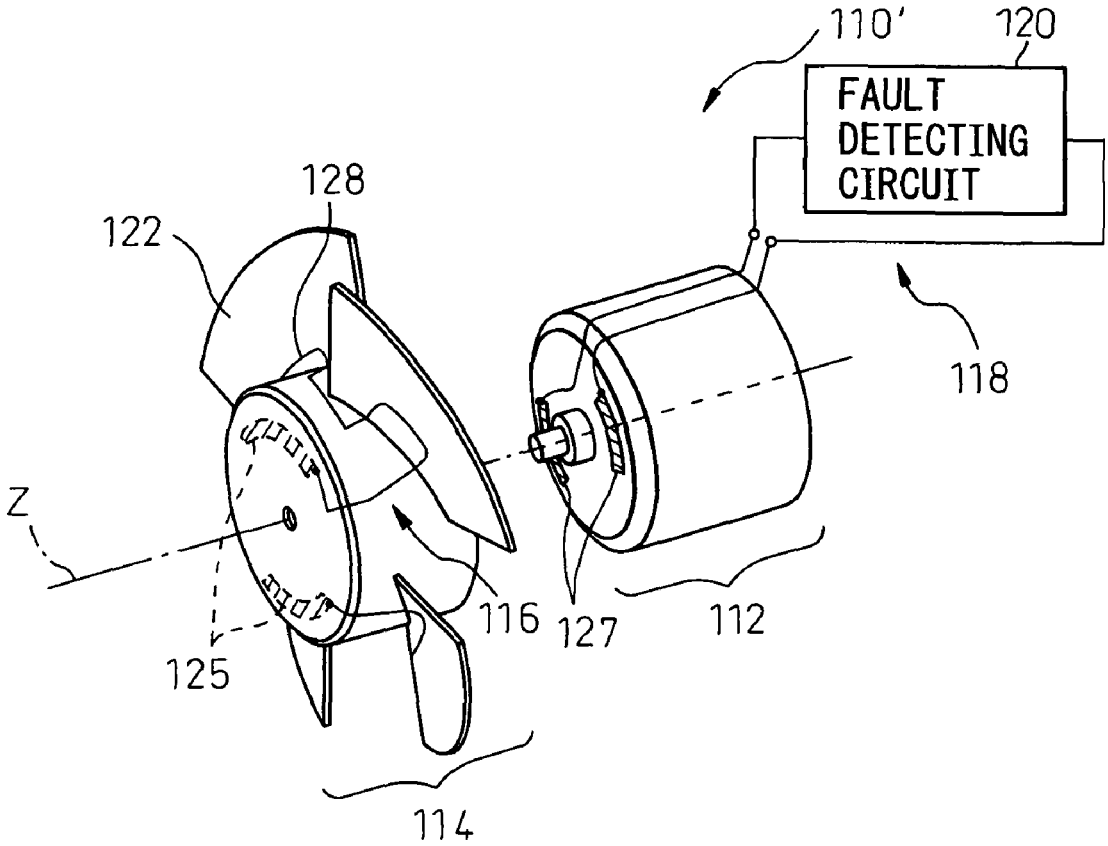
FIG. 16 is a perspective view of the fan according to the second embodiment of the invention further including an electric wire for detecting a breakage of the fan.
Figure 17:
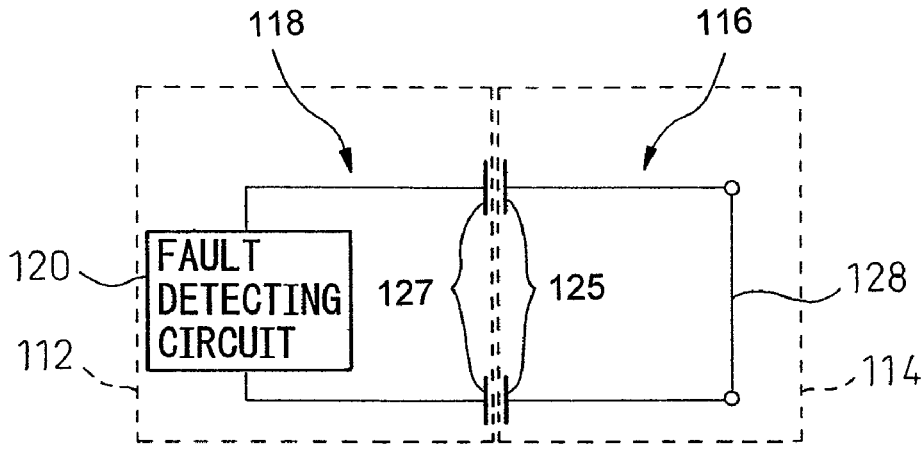
FIG. 17 is a diagram showing an equivalent circuit of an electric circuit of the fan of FIG. 16.

Similarly to the fan of the first embodiment, the fan of the second embodiment may further include a function for detecting a loss of a portion of the rotating part 114, such as a vane 122. As shown in FIG. 16, a first electric circuit 116 of a fan 110' of the second embodiment may further have an electric wire 128, connected to the first electrode 125 and arranged along the vane 122, for detecting a breakage of the vane. FIG. 17 shows an equivalent circuit of the configuration of FIG. 16. Due to this configuration, when the vane 122 is damaged or lost, the wire 128 is also broken and the current does not flow through the first circuit 116, which may be detected by the above fault detecting circuit 120 of the second electric circuit 118.

A central angle of each of the two arcs of the first and second electrodes 125 and 127 may be any angle as far as the amplitude of the current may be altered by changing the relative rotational position of the rotating part 114 to the stationary part 112. Preferably, the central angle of each of the arcs is within 45-90 degrees. Although each electrode has two arcs in the embodiment, it should be understood that the shape of the electrode is not limited to the arc.

Figure 18:
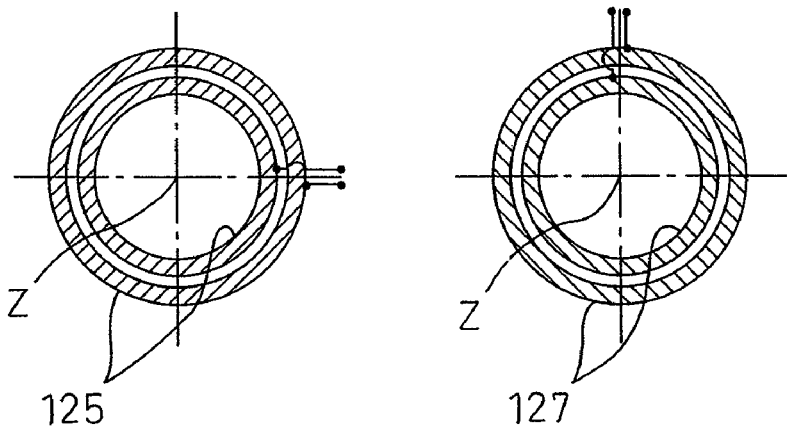
FIG. 18 shows another configuration of electrodes for detecting a breakage or a loss of the rotating part.

When the fault detecting circuit 120 is required to detect only the loss of the rotating part, each of the first and second electrodes 125 and 127 may have the shape of circle, the center of which coincides with each other, as shown in FIG. 18. In this case, the amplitude of the current does not periodically change as shown in FIG. 4*a* or 4*b* even when the rotational speed of the fan is changed. However, the loss of the rotating part 114 may be detected because the current is remarkably reduced by the weakened connection between the two electrodes.

As each of the above fans 10 and 10' according the first embodiment has an electric circuit including a coil, the rotating part 14 of the fan is preferably made of a nonmagnetic material. Also, as each of the above fans 110 and 110' according the second embodiment has an electric circuit including an electrode, the rotating part 114 of the fan is preferably made of a nonconductive material. Therefore, a malfunction of the fault detecting circuit may be avoided, whereby a reliable detecting of a fault of the fan may be performed.

According to the fan of the invention having a function for detecting a fault of the fan, by means of the fault detecting circuit of the second electric circuit, an abnormal rotational speed or an inconvenient stoppage of the fan may be surely detected without relying on visual inspection. The detection may be performed by a simple configuration such as first and second electric circuits each including a coil or an electrode. Further, by arranging an electric wire for detecting a breakage in the first electric circuit, the breakage of a portion of the rotating part of the fan may be detected. In addition, a malfunction of the fault detecting circuit may be avoided and a reliable detecting of a fault of the fan may be performed, by forming the rotating part from a nonmagnetic material when the first and second electric circuit include the coils, or, by forming the rotating part from a nonconductive material when the first and second electric circuit include the electrodes.

While the invention has been described with reference to specific embodiments chosen for the purpose of illustration, it should be apparent that numerous modifications could be made thereto, by one skilled in the art, without departing from the basic concept and scope of the invention.

The invention claimed is:

1. A fan comprising:

a stationary part;

a rotating part rotatably attached to the stationary part;

a first electric circuit arranged on the rotating part;

a second electric circuit arranged on the stationary part, the second electric circuit being electrically, magnetically or electromagnetically connected to the first circuit; and a fault detecting circuit electrically connected to the second electric circuit, for detecting a fault of the rotating part based on a value of a current flowing through the second electric circuit, wherein the first and second electric circuits respectively have first and second coils adjacent to each other, and each of the first and second coils is formed in the shape of oval, the ovals being generally congruent and the centers of the ovals being positioned on a rotational axis of the rotating part.

2. The fan as set forth in claim 1, wherein the rotating part is made of a nonmagnetic material.

3. A fan comprising:

a stationary part;

a rotating part rotatably attached to the stationary part;

a first electric circuit arranged on the rotating part;

a second electric circuit arranged on the stationary part, the second electric circuit being electrically, magnetically or electromagnetically connected to the first circuit; and a fault detecting circuit electrically connected to the second electric circuit, for detecting a fault of the rotating part based on a value of a current flowing through the second electric circuit, wherein the first and second electric circuits respectively have first and second coils adjacent to each other, and each of the first and second coils is formed in the shape of a circle such that at least one of the first and second coils is not concentric with the rotational axis of the rotating part.

4. The fan as set forth in claim 3, wherein the first electric circuit has an electric wire for detecting a breakage of a portion of the rotating part.

5. A fan comprising:

a stationary part;

a rotating part rotatably attached to the stationary part;

a first electric circuit arranged on the rotating part;

a second electric circuit arranged on the stationary part, the second electric circuit being electrically, magnetically or electromagnetically connected to the first circuit; and a fault detecting circuit electrically connected to the second electric circuit, for detecting a fault of the rotating part based on a value of a current flowing through the second electric circuit, wherein the first and second electric circuits respectively have first and second electrodes adjacent to each other, and each of the first and second electrodes has two arcs opposed each other in relation to a rotational axis of the rotating part, the arcs of the first electrode and the arcs of the second electrode having the same radius, the central angle of each of the arcs being within 45-90 degrees.

6. The fan as set forth in claim 5, wherein the rotating part is made of a nonconductive material.

7. The fan as set forth in claim 5, wherein the first electric circuit has an electric wire for detecting a breakage of a portion of the rotating part.

8. The fan as set forth in claim 1, wherein the first electric circuit has an electric wire for detecting a breakage of a portion of the rotating part.

9. The fan as set forth in claim 3, wherein the rotating part is made of a nonmagnetic material.

* * * * *